US008636561B2

(12) United States Patent
Masumura et al.

(10) Patent No.: US 8,636,561 B2
(45) Date of Patent: Jan. 28, 2014

(54) POLISHING HEAD AND POLISHING APPARATUS

(75) Inventors: Hisashi Masumura, Nishishirakawa (JP); Hiromasa Hashimoto, Nishishirakawa (JP); Kouji Morita, Nishishirakawa (JP); Hiromi Kishida, Nagano (JP); Satoru Arakawa, Nagano (JP)

(73) Assignees: Shin-Etsu Handotai Co., Ltd., Tokyo (JP); Fujikoshi Machinery Corp., Nagano (JP)

( * ) Notice: Subject to any disclaimer, the term of this patent is extended or adjusted under 35 U.S.C. 154(b) by 137 days.

(21) Appl. No.: 13/056,249

(22) PCT Filed: Aug. 7, 2009

(86) PCT No.: PCT/JP2009/003796

§ 371 (c)(1),
(2), (4) Date: Jan. 27, 2011

(87) PCT Pub. No.: WO2010/023829

PCT Pub. Date: Mar. 4, 2010

(65) Prior Publication Data

US 2011/0136414 A1 Jun. 9, 2011

(30) Foreign Application Priority Data

Aug. 29, 2008 (JP) ..... 2008-222039

(51) Int. Cl.
*B24B 37/04* (2012.01)
*H01L 21/304* (2006.01)

(52) U.S. Cl.
USPC ..... 451/67; 451/285; 451/289; 451/388

(58) Field of Classification Search
USPC ..... 451/285–290, 388, 390, 41, 56
See application file for complete search history.

(56) References Cited

U.S. PATENT DOCUMENTS 5,584,746 A * 12/1996 Tanaka et al. ..... 451/41
5,584,751 A * 12/1996 Kobayashi et al. ..... 451/288
5,624,299 A * 4/1997 Shendon ..... 451/28
5,851,140 A * 12/1998 Barns et al. ..... 451/288

(Continued)

FOREIGN PATENT DOCUMENTS

CN A-1567539 1/2005
JP A-5-69310 3/1993

(Continued)

OTHER PUBLICATIONS

Office Action issued in JP Application No. 2010-526516 on May 31, 2011 (with partial English translation).

(Continued)

*Primary Examiner* — Lee D Wilson
*Assistant Examiner* — Tyrone V Hall, Jr.
(74) *Attorney, Agent, or Firm* — Oliff & Berridge, PLC

(57) ABSTRACT

A polishing head for holding a workpiece when a surface of the workpiece is polished and a polishing apparatus provided with the polishing head, and more particularly a polishing head for holding the workpiece on a rubber film and a polishing apparatus provided with the polishing head. The polishing head and the polishing apparatus provided with the polishing head that can adjust the polishing profile on the basis of the shape of the workpiece before polishing and can stably obtain good flatness.

10 Claims, 7 Drawing Sheets

(56) References Cited

U.S. PATENT DOCUMENTS

| | | | | |
|---|---|---|---|---|
| 5,879,220 | A * | 3/1999 | Hasegawa et al. | 451/288 |
| 5,957,751 | A * | 9/1999 | Govzman et al. | 451/8 |
| 5,964,653 | A * | 10/1999 | Perlov et al. | 451/288 |
| 6,162,116 | A * | 12/2000 | Zuniga et al. | 451/285 |
| 6,210,255 | B1 * | 4/2001 | Zuniga et al. | 451/41 |
| 6,443,820 | B2 * | 9/2002 | Kimura | 451/285 |
| 6,572,438 | B2 * | 6/2003 | Numoto | 451/3 |
| 6,722,965 | B2 * | 4/2004 | Zuniga et al. | 451/288 |
| 6,979,250 | B2 * | 12/2005 | Zuniga et al. | 451/41 |
| 8,021,210 | B2 * | 9/2011 | Masumura et al. | 451/8 |
| 2003/0008604 | A1 * | 1/2003 | Boo et al. | 451/388 |
| 2004/0137829 | A1 | 7/2004 | Park et al. | |
| 2004/0175951 | A1 * | 9/2004 | Chen | 438/692 |
| 2004/0192173 | A1 * | 9/2004 | Zuniga et al. | 451/41 |
| 2006/0025058 | A1 * | 2/2006 | Tseng et al. | 451/288 |
| 2007/0202785 | A1 * | 8/2007 | Oh et al. | 451/402 |

FOREIGN PATENT DOCUMENTS

| | | |
|---|---|---|
| JP | A-11-179652 | 7/1999 |
| JP | A-2002-187060 | 7/2002 |
| JP | A-2003-31531 | 1/2003 |
| JP | A-2004-516644 | 6/2004 |
| JP | A-2004-216548 | 8/2004 |
| JP | A-2004-311506 | 11/2004 |
| KR | 10-2004-0064827 | 7/2004 |
| TW | 520319 B | 2/2003 |
| WO | WO 02/07931 A2 | 1/2002 |

OTHER PUBLICATIONS

Japanese Office Action dated Jan. 12, 2011 issued in Japanese Patent Application No. 2010-526516 (with partial translation).

International Search Report mailed Nov. 2, 2009 issued in International Patent Application No. PCT/JP2009/003796 (with translation).

International Preliminary Report on Patentability issued in Application No. PCT/JP2009/003796 on Apr. 21, 2011.

Feb. 5, 2013 Office Action issued in Chinese Patent Application No. 200980132819.0 (with translation).

Sep. 26, 2013 Office Action issued in Taiwanese Patent Application No. 098128540 (with partial translation).

* cited by examiner

POLISHING HEAD AND POLISHING APPARATUS

TECHNICAL FIELD

The present invention relates to a polishing head for holding a workpiece when a surface of the workpiece is polished and a polishing apparatus provided with the polishing head, and more particularly to a polishing head for holding the workpiece on a rubber film and a polishing apparatus provided with the polishing head.

BACKGROUND ART

As an apparatus for polishing a surface of a workpiece such as a silicon wafer, there are a single-side polishing apparatus, in which the workpiece is polished by each side, and a double-side polishing apparatus, in which the both sides of the workpiece are polished at the same time.

For example as shown in FIG. 10, a common single-side polishing apparatus comprises a turn table 88 onto which a polishing pad 89 is attached, a polishing agent supply mechanism 90, a polishing head 81 and the like. This polishing apparatus 82 polishes a workpiece W by holding the workpiece W with the polishing head 81, supplying a polishing agent onto the polishing pad 89 through the polishing agent supply mechanism 90, rotating the turn table 88 and the polishing head 81 respectively, and bringing a surface of the workpiece W into sliding contact with the polishing pad 89.

As a method for holding the workpiece with the polishing head, for example, there is a method of attaching the workpiece onto a flat disk-shaped plate through an adhesive such as a wax. Other than that, particularly as a holding method of suppressing rise and sag on an outer circumferential portion of the workpiece and of improving flatness of the whole workpiece, there is a so-called rubber-chuck method in which a workpiece holding portion is made of an elastic film, a pressurized fluid such as air is poured into a back face of the elastic film, and the elastic film is inflated by a uniform pressure so as to press the workpiece toward the polishing pad (See Patent Literature 1, for example).

An example of the structure of a conventional polishing head by the rubber-chuck method is schematically shown in FIG. 9. An essential part of this polishing head 101 consists of an annular rigid ring 104 made of SUS and the like, the rubber film 103 bonded to the rigid ring 104, and a mid plate 105 joined to the rigid ring 104. A sealed space 106 is defined by the rigid ring 104, the rubber film 103, and the mid plate 105. An annular template 114 is provided concentrically with the rigid ring 104 in a peripheral portion on a lower face portion of the rubber film 103. The pressure of the space is adjusted, for example, by supplying a pressurized fluid with a pressure adjustment mechanism 107 in a center of the mid plate 105. A pressing means, not shown, for pressing the mid plate 105 in the direction of the polishing pad 109 is provided.

With the polishing head 101 configured as above, the workpiece W is held on the lower face portion of the rubber film 103 through a backing pad 113, an edge portion of the workpiece W is held with the template 114, and the workpiece W is polished by bringing it into sliding contact with the polishing pad 109 attached onto an upper face of the turn table 108 by pressing the mid plate 105.

With regard to polishing of the workpiece by using the above-described polishing head, for the purpose of Improving uniformity of the polishing, there are disclosed a carrier head by the rubber-chuck method that enables a wafer to be pressed with a plurality of annular portions concentric with one another (See Patent Literature 2) and a substrate-holding apparatus in which a plurality of pressure chambers are provided inside a space formed between an elastic pad and a holding member (See Patent Literature 3).

CITATION LIST

Patent Literature

Patent Literature 1: Japanese Unexamined Patent publication (Kokai) No. H05-69310

Patent Literature 2: Japanese Unexamined Patent publication (Kokai) No. 2004-516644

Patent Literature 3: Japanese Unexamined Patent publication (Kokai) No. 2002-187060

SUMMARY OF INVENTION

When the workpiece W is polished by using the polishing head 101 holing the workpiece W on the rubber film 103 as described above, the flatness and the polishing stock removal uniformity of the whole workpiece W may be improved in some cases, but there is a problem that stable flatness of the workpiece W cannot be obtained, for example, due to an influence of variation of the thickness of the workpiece and the template.

Moreover, in the event that an original shape of the workpiece W before polishing is not flat, it is necessary to adjust a polishing profile in order to modify the shape of the workpiece W. A conventional polishing head by the rubber-chuck method, however, cannot readily change the polishing profile, and such an adjustment is thus difficult.

The present invention was accomplished in view of the above-explained problems, and its main object is to provide a polishing head and a polishing apparatus provided with the polishing head that can adjust the polishing profile on the basis of the shape of the workpiece before polishing and can stably obtain good flatness.

To achieve this object, the present invention provides a polishing head including at least: an annular rigid ring; a rubber film bonded to the rigid ring with a uniform tension; a mid plate joined to the rigid ring, the mid plate forming a space together with the rubber film and the rigid ring; an annular template provided concentrically with the rigid ring in a peripheral portion on a lower face portion of the rubber film; and a pressure adjustment mechanism for changing pressure of the space, the polishing head holding a back surface of a workpiece on the lower face portion of the rubber film, holding an edge portion of the workpiece with the template, and polishing the workplace by bringing a surface of the workpiece into sliding contact with a polishing pad attached onto a turn table, wherein the space is divided by at least one annular wall concentric with the rigid ring to form a plurality of sealed spaces; an outer diameter of at least one inside sealed space of the plurality of sealed spaces divided by the annular wall is formed so as to be equal to or more than a diameter of a flatness-guaranteed region of the workpiece; and the pressure adjustment mechanism separately controls pressure of each of the plurality of sealed spaces.

In this manner, when the workpiece is held with the rubber film greatly larger than the workpiece; the space is divided by at least one annular wall concentric with the rigid ring to form a plurality of sealed spaces; an outer diameter of at least one inside sealed space of the plurality of sealed spaces divided by the annular wall is formed so as to be equal to or more than a diameter of a flatness-guaranteed region of the workpiece; and the pressure adjustment mechanism separately controls pressure of each of the plurality of sealed spaces, polishing can be performed with giving a uniform polishing pressure to the workpiece without an influence of a change in pressure due to pressure adjustment of each of the sealed spaces, on an inside of the diameter of the flatness-guaranteed region of the workpiece.

As a result, even when there are somewhat variation of the thickness of the workpiece and the template, good flatness and polishing stock removal uniformity can be always secured. In the event that the shape of the workpiece before polishing is not flat, the polishing profile can be readily changed by adjusting the pressure of each of the sealed spaces on the basis of the shape thereof, and the shape of the workpiece can be modified into a flat shape.

In this case, at least one other sealed space concentric with the rigid ring can be further formed inside the sealed space having the outer diameter formed so as to be equal to or more than the diameter of the flatness-guaranteed region of the workpiece.

In this manner, when at least one other sealed space concentric with the rigid ring is further formed inside the sealed space having the outer diameter formed so as to be equal to or more than the diameter of the flatness-guaranteed region of the workpiece, the polishing can be performed with giving a more uniform polishing pressure to the workpiece, and better flatness and polishing stock removal uniformity can be secured. In addition to this, in the event that the shape of the workpiece before polishing is not flat, the pressure of each of the sealed spaces can be more precisely adjusted on the basis of the shape thereof, and the shape of the workpiece can be modified into a flatter shape.

In this case, the workpiece to be polished can be a silicon single crystal wafer having a diameter of 300 mm or more.

In this manner, even when the workpiece to be polished is a silicon single crystal wafer having a large diameter of 300 mm or more, the polishing can be performed with giving a more uniform polishing pressure to the whole surface of the workpiece according to the present invention, good polishing stock removal uniformity can be secured.

In this case, the outer diameter of the at least one inside sealed space of the plurality of sealed spaces divided by the annular wall is preferably equal to or less than 102% of an inner diameter of the template.

In this manner, when the outer diameter of the at least one inside sealed space of the plurality of sealed spaces divided by the annular wall is equal to or less than 102% of an inner diameter of the template, the change in pressure can be given to the workpiece with suppressing an influence of the rigidity of the template, and the polishing pressure on the workpiece can be efficiently adjusted.

Furthermore, the present invention provides a polishing apparatus used for polishing a surface of a workpiece including at least a polishing pad attached onto a turn table, a polishing agent supply mechanism for supplying a polishing agent onto the polishing pad, and the polishing head according to the present invention as a polishing head for holding the workpiece.

In this manner, when the workpiece is polished by using the polishing apparatus provided with the polishing head according to the present invention, the polishing can be performed with giving a uniform polishing pressure to the workpiece, and even when there are somewhat the variation of the thickness of the workpiece and the template, good flatness and polishing stock removal uniformity can be always secured. In the event that the shape of the workpiece before the polishing is not flat, the polishing profile can be readily changed by adjusting the pressure of each of the sealed spaces on the basis of the shape thereof, and the shape of the workpiece can be modified into a flat shape.

In the polishing head according to the present invention, the space is divided by at least one annular wall concentric with the rigid ring to form a plurality of sealed spaces; an outer diameter of at least one inside sealed space of the plurality of sealed spaces divided by the annular wall is formed so as to be equal to or more than a diameter of a flatness-guaranteed region of the workpiece; and the pressure adjustment mechanism separately controls pressure of each of the plurality of sealed spaces. The polishing can be therefore performed with giving a uniform polishing pressure to the workpiece, and even when there are somewhat the variation of the thickness of the workpiece and the template, good flatness and polishing stock removal uniformity can be always secured. In addition to this, in the event that the shape of the workpiece before polishing is not flat, the polishing profile can be readily changed by adjusting the pressure of the sealed space on the basis of the shape thereof, and the shape of the workpiece can be modified into a flat shape.

DESCRIPTION OF EMBODIMENTS

Figure 1:
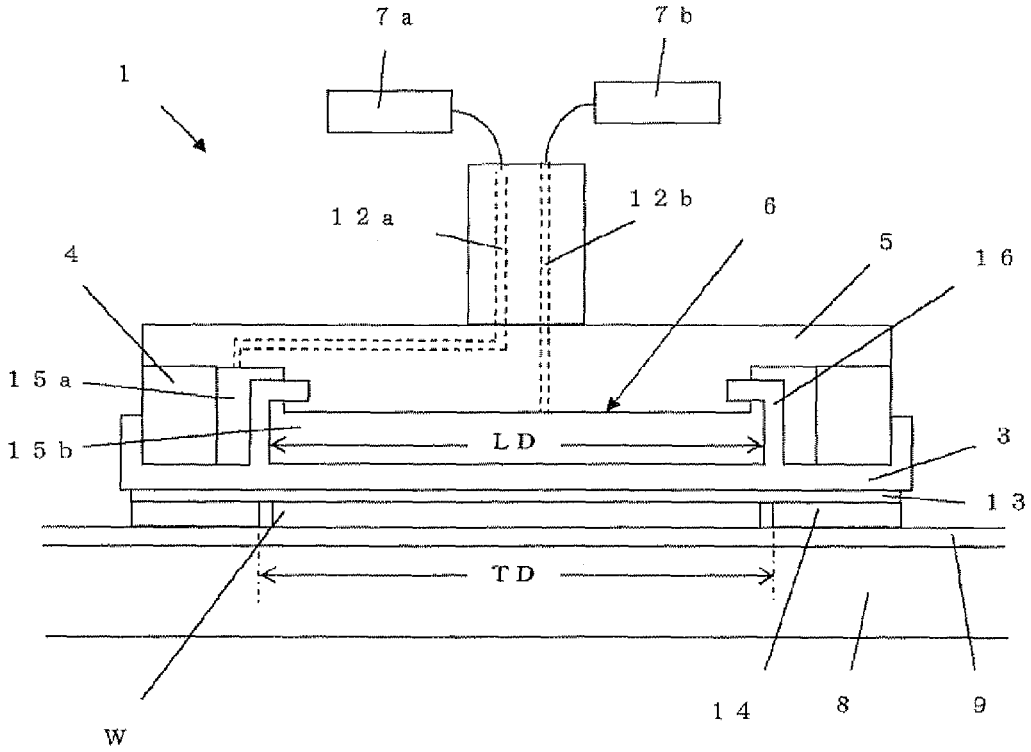
FIG. 1 is a schematic view showing an example of the polishing head according to the present invention.

Hereinafter, an embodiment of the present invention will be explained, but the present invention is not restricted thereto.

When the workpiece is polished with the workpiece held on an elastic film by using a conventional polishing head, there is a problem that good flatness cannot be stably obtained, for example, due to the influence of the variation of the thickness of the workpiece and the template. Moreover, in the event that the shape of the workpiece before polishing is not flat, it is necessary to adjust the polishing profile in order to modify the shape of the workpiece. There is, however, a problem that a conventional polishing head cannot readily adjust the polishing profile, and it is therefore necessary to change the polishing head itself into a polishing head having a desired polishing profile to polish in practice.

In view of this, the present inventors repeatedly keenly conducted experiments and studies to solve the above-described problems.

As a result, the present inventors found the following.

That is, in the event that a size of the rubber film for holding the workpiece to be polished is approximately equal or somewhat larger than that of the workpiece, there are instances that the polishing pressure on the workpiece becomes nonuniform particularly in the outer circumferential portion of the workpiece.

Moreover, when a position of a lower face of the template holding the edge portion of the workpiece is located below a position of a lower face of the workpiece to be polished, that is, when the lower face of the template protrudes from the lower face of the workpiece, the outer circumference is formed into a rise-shape due to a decrease in the polishing pressure on the outer circumferential portion of the workpiece. On the contrary, when the position of the lower face of the template is located above the position of the lower face of the workpiece, that is, when the lower face of the workpiece protrudes from the lower face of the template, the outer circumference is formed into a sag-shape due to an increase in the polishing pressure on the outer circumferential portion of the workpiece.

The present inventors found that the flatness cannot be obtained due to nonuniformity of the polishing pressure of the workpiece as described above.

The present inventors also found that, in theory, a uniform polishing load can be given to the workpiece by rigidly managing the thickness of the workpiece and template and by adjusting the position of the lower face of the template and the position of the lower face of the workpiece so as to be equal to one another and that the workpiece can be modified into a flat shape by adjusting the thickness of the template on the basis of a processing shape of the workpiece.

However, for example, in case of the workpiece of a silicon wafer, the workpiece has a thickness variation of approximately several microns, and the template also has a thickness variation of approximately several microns. It is therefore difficult to always adjust the position of the lower face of the template and the position of the lower face of the workpiece so as to be equal to one another in practice. It is also difficult to adjust the thickness of the template on the basis of the shape of the workpiece before polishing.

The present inventors thereupon repeatedly keenly conducted experiments and studies further and found that the uniformity of the polishing pressure on the workpiece can be improved by using the rubber film for holding the workpiece, the rubber film which is greatly larger than the workpiece, and that the polishing stock removal uniformity can be thereby improved. Furthermore, with regard to the outer circumferential portion of the workpiece in which the change in the pressure mainly occur, the present inventors conceived that polishing pressure distribution in a plane of the workpiece can be readily adjusted by means of dividing the space, which is formed by the rigid ring; the mid plate joined to the rigid ring; and the rubber film, by a plurality of walls so as to form a sealed space having a diameter larger than that of the flatness-guaranteed region of the workpiece and particularly larger than the outer diameter of the workpiece, and so as to be capable of separately adjusting the pressure, and by means of adjusting the pressure of each of the sealed spaces with the pressure adjustment mechanism. The present invention has been thereby brought to completion.

FIG. 1 is a schematic view showing an example of the polishing head according to the present invention.

As shown in FIG. 1, the polishing head 1 includes the annular rigid ring 4 made of a rigid material, such as SUS (stainless steel), the rubber film 3 (an elastic film) that is bonded to the rigid ring 4 with a uniform tension and that has a flat lower face, the mid plate 5 joined to the rigid ring 4, for example, with bolts.

A sealed space 6 is formed by the rigid ring 4, the rubber film 3 and the mid plate 5.

Here, a material and a shape of the mid plate 5 are not restricted in particular as long as the space 6 can be formed together with the rigid ring 4 and the rubber film 3.

Moreover, as shown in FIG. 1, the polishing head 1 has the pressure adjustment mechanisms 7*a* and 7*b* for changing the pressure of the space 6.

The annular template 14 is provided concentrically with the rigid ring 4 in the peripheral portion of the lower face portion of the rubber film 3. This template 14 holds the edge portion of the workpiece W and is provided so as to project downward along the outer circumferential portion of the lower face portion of the rubber film 3.

In this way, the rubber film 3 and the template 14 are configured to have the structure such that the rubber film 3 is greatly larger than the workpiece W.

This structure such that the rubber film 3 is greatly larger than the workpiece W enables the uniformity of the polishing pressure on the workpiece W to be improved during polishing, and the polishing stock removal uniformity can be thereby improved.

Here, the template 14 can be configured such that its outer diameter is larger than at least an inner diameter of the rigid ring 4 and its inner diameter is smaller than the inner diameter of the rigid ring 4.

By this configuration, polishing can be performed with more uniform pressing force applied to the whole surface of the workpiece.

Moreover, it is preferable that a material of the template 14 is softer than the workpiece W so as not to contaminate the workpiece W and so as not to give a scratch or an impression, and that it is a high abrasion resistance material that is hard to wear out due to sliding contact with the polishing pad 9 during polishing.

As shown in FIG. 1, the space 6 is divided by the annular wall 16 concentric with the rigid ring 4 to form a plurality of sealed spaces 15*a* and 15*b*. In an example of the polishing head 1 shown in FIG. 1, two sealed spaces are formed. However, this is not restricted and two or more sealed spaces can be formed.

Here, as shown in FIG. 1, the wall 16 is formed to have a flat brim extending inside at a tip upper portion, and a part of the brim is coupled to the mid plate 5. However, the present invention is not restricted by this shape as long as it is such a shape that the sealed spaces can be formed.

Moreover, a material of the wall 16 can be the same as the rubber film 3, and they can be formed into a single piece. Alternatively, an another material may be adhered or melt-bonded to the rubber film 3, and it is preferably a soft material such as the rubber film 3.

Moreover, the thickness of the wall 16 is not restricted in particular, and a suitable thickness can be appropriately selected according to the structure of the polishing head 1. For example, it can be a thickness of appropriately 1 mm.

The outer diameter LD of the inside sealed space 15*b* of the plurality of sealed spaces divided by the annular wall 16 is formed so as to be equal to or more than the diameter of the flatness-guaranteed region of the workpiece W.

When the sealed spaces 15*a* and 15*b* are formed as described above, the polishing pressure on the workpiece W can be adjusted by making a difference in pressure between two sealed spaces 15*a* and 15*b* divided by the wall 16.

Here, when the difference in pressure made between both of the sealed spaces 15*a* and 15*b* is large, a change in pressure becomes large at a position of the wall 16, which is a boundary part. When the outer diameter of the sealed space 15*b* is equal to or more than the diameter of the flatness-guaranteed region of the workpiece W and particularly equal to or more than the outer diameter thereof, the uniformity within the flatness-guaranteed region of the workpiece W can be prevented from being directly exerted a bad influence of the change in pressure. In addition, when the outer diameter LD of the sealed space 15*b* is equal to or less than 102% of the inner diameter TD of the template 14, and particularly equal to or less than the inner diameter TD of the template 14, the change in pressure on the workpiece W can be prevented from becoming hard to be given by suppressing movement of the rubber film 3 due to the influence of the rigidity of the template 14. That is, the polishing head can efficiently adjust the polishing pressure on the workpiece W.

Through holes 12*a* and 12*b* for pressure adjustment, communicating with each of the sealed spaces 15*a* and 15*b* are provided, and are connected to the pressure adjustment mechanisms 7*a* and 7*b*. The pressure of each of the sealed spaces 15*a* and 15*b* can be separately controlled with the pressure adjustment mechanisms 7*a* and 7*b*.

As described above, the polishing head 1 according to the present invention has the rubber film 3 larger than the workpiece W, the outer diameter LD of the at least one inside sealed space 15*b* of the plurality of sealed spaces 15*a* and 15*b* divided by the annular wall is formed so as to be equal to or more than the diameter of the flatness-guaranteed region of the workpiece W and particularly equal to or more the outer diameter. By separately controlling the pressure of each of the sealed spaces 15*a* and 15*b* with the pressure adjustment mechanisms 7*a* and 7*b*, the polishing can be therefore performed with giving a uniform polishing pressure to the workpiece W without directly producing, within the workpiece W, the influence of the change in pressure due to pressure adjustment of each of the sealed spaces, and even when there are somewhat the variation of the thickness of the workpiece W and the template 14, good flatness can be always secured, and good polishing stock removal uniformity of, for example, 2.5% or less can be secured.

Moreover, in the event that the shape of the workpiece W before polishing is not flat, the polishing profile can be readily changed by adjusting the pressure of each of the sealed spaces on the basis of the shape thereof, and the shape of the workpiece can be modified into a flat shape. That is, a protruding amount at the periphery of the workpiece W from the lower face of the template 14 can be adjusted, and a polishing amount at the periphery of the workpiece W can be thereby adjusted.

In this case, a backing pad 13 can be attached to be provided on the lower face of the rubber film 3. The backing pad 13 is made to contain water so as to attach and to hold the workpiece W on a workpiece holding face of the rubber film 3. Here, the backing pad 13 can be made of, for example, polyurethane. By providing the above-described backing pad 13 and having it contain water, the workpiece W can be surely held by surface tension of the water contained in the backing pad 13.

It is to be noted that an embodiment of attaching the template 14 onto the rubber film 3 through the backing pad 13 and the like is shown in FIG. 1, but the present invention does not exclude a case of attaching the template 14 directly onto the rubber film 3.

The polishing head 1 is rotatable about its axis.

Figure 2:
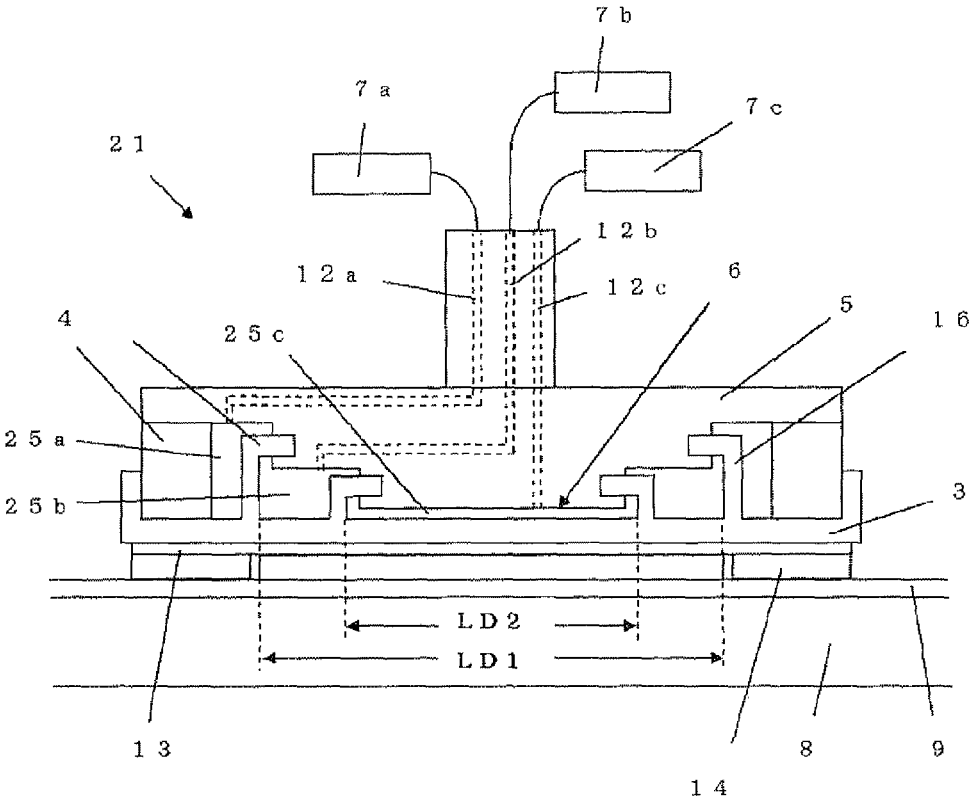
FIG. 2 is a schematic view showing another example of the polishing head according to the present invention.

In this case, as shown in FIG. 2, the polishing head 21 can be configured in such a manner that other sealed space 25*c* concentric with the rigid ring 4 is further formed inside the sealed space 25*b* having the outer diameter LD1 formed so as to be equal to or more than the diameter of the flatness-guaranteed region of the workpiece W.

The pressure of the sealed space 25*b* can be adjusted by slightly changing it as compared with the pressure of the sealed space 25*c*.

As described above, when the polishing head 21 is configured in such a manner that other sealed space 25*c* concentric with the rigid ring 4 is further formed inside the sealed space 25*b* having the outer diameter LD1 formed so as to be equal to or more than the diameter of the flatness-guaranteed region of the workpiece W and particularly equal to or more than the outer diameter of the workpiece W, the pressure of the sealed space 25*b* can be adjusted by slightly changing it as compared with the pressure of the sealed space 25*c*, the polishing can be performed with giving a more uniform polishing pressure to the workpiece W, and better flatness and polishing stock removal uniformity can be secured.

In addition to this, for example, the protruding amount of the workpiece W from the template 14 can be adjusted with high precision by changing the pressure of the sealed spaces 25*a*, 25*b*, and 25*c* with the pressure adjustment mechanisms 7*a*, 7*b*, and 7*c*, and the outer circumferential portion of the workpiece W can be therefore formed into a rise-shape or sag-shape. Moreover, the polishing profile can be changed by optimizing the pressure of the sealed spaces 25*a*, 25*b*, and 25*c* on the basis of the shape of the workpiece W before polishing without changing the thickness of the template 14 and the like, and the shape of the workpiece W can be more effectively modified into a flat shape.

In this case, the workpiece W to be polished can be a silicon single crystal wafer having a diameter of 300 mm or more.

As described above, even when the workpiece W to be polished is a silicon single crystal wafer having a large diameter of 300 mm or more, the polishing can be performed with a more uniform polishing pressure over the whole surface of the workpiece W according to the present invention, good polishing stock removal uniformity can be secured.

Figure 3:
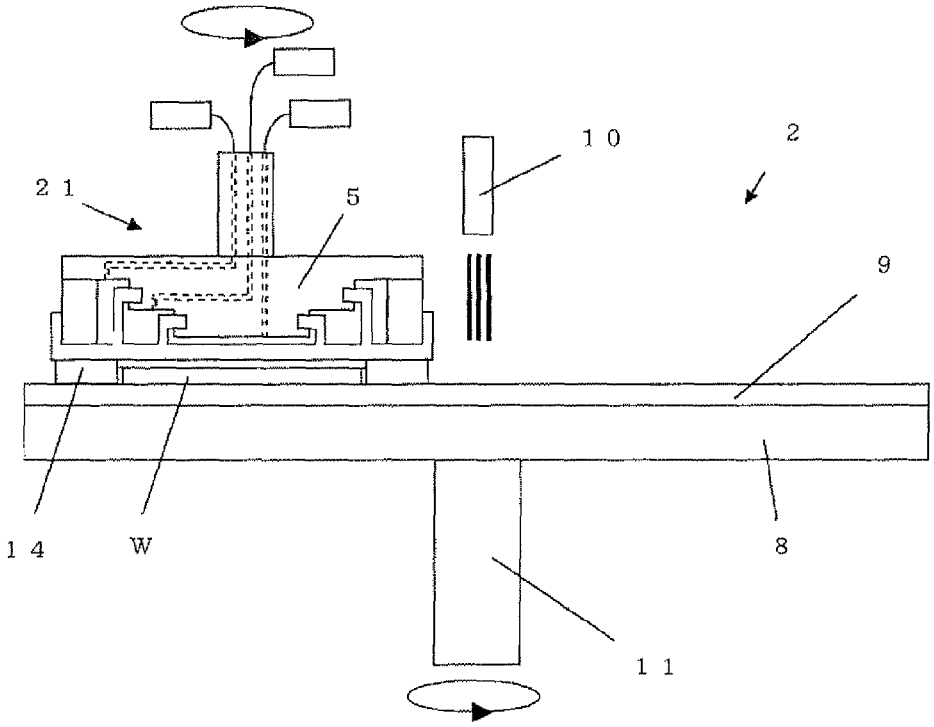
FIG. 3 is a schematic view showing an example of the polishing apparatus according to the present invention.

FIG. 3 is a schematic view showing an example of the polishing apparatus provided with the polishing head 21 according to the present invention.

As shown in FIG. 3, the polishing apparatus 2 includes the polishing head 21 as shown in FIG. 2 and the turn table 8. The turn table 8 is of disk shape, and the polishing pad 9 for polishing the workpiece W is attached onto its upper face. A driving shaft 11 is vertically connected to an lower portion of the turn table 8. The turn table 8 is configured to be rotated by a turn-table-rotating motor (not shown) connected to an lower portion of the driving shaft 11.

The polishing head 21 is arranged above the turn table 8.

Here, the polishing apparatus 2 as shown in FIG. 3 includes one polishing head, but may includes a plurality of polishing heads.

The polishing apparatus also has a mid-plate-pressing means for pressing the mid plate 5 toward the polishing pad 9 (not shown).

With the polishing apparatus 2 configured as described above, the mid plate 5 is pressed toward the polishing pad 9 attached onto the turn table 8 by the mid-plate-pressing means, not shown, and the surface of the workpiece W is polished by bringing it into sliding contact with the polishing pad 9 while the polishing agent is supplied through the polishing agent supply mechanism 10. Here, mid-plate-pressing means is preferably able to press the mid plate 5 over the whole surface with a uniform pressure.

In this way, when the workpiece W is polished by using the polishing apparatus 2 provided with the polishing head according to the present invention, the polishing can be performed with giving a uniform polishing pressure to the workpiece W, and even when there are somewhat the variation of the thickness of the workpiece W and the template 14, the protruding amount of the workpiece W from the template 14 can be adjusted, and good flatness and polishing stock removal uniformity can be always secured. In addition, in the event that the shape of the workpiece W before polishing is not flat, the polishing profile can be readily changed by adjusting the pressure of each of the sealed spaces on the basis of the shape thereof, and the shape of the workpiece can be modified into a flat shape.

Hereinafter, the present invention will be explained in more detail based on Examples and Comparative Examples, but the present invention is not restricted thereto.

Example 1

The polishing head 1 according to the present invention as shown in FIG. 1 and the polishing apparatus provided with the polishing head were used to polish the workpiece W, and the pressure distribution of the workpiece during the polishing and the polishing stock removal uniformity were evaluated.

The structure of the used polishing head 1 was as follows.

The rigid ring 4 had an outer diameter of 358 mm and an inner diameter of 320 mm, and was made of SUS. The rubber film 3 was made of silicone rubber having a hardness of 70 (based on JIS K6253), and had a thickness of 1 mm.

In addition, the space 6 was divided by the annular wall 16 concentric with the rigid ring 4 to form two sealed spaces 15*a* and 15*b*. The outer diameter LD of the inside sealed space 15*b* was 300 mm. Here, the wall 16 had a thickness of 1 mm, and was made of the same material as the rubber film 3.

Moreover, the backing pad 13 was attached to be provided on the lower face of the rubber film 3 by double-stick tape. A template assembly, in which the template 14 made of glass epoxy stacked layer sheet having a thickness of 800 μm was bonded, was adhered to a lower face of the backing pad 13 by double-stick tape. The outer diameter of the template 14 was 355 mm and its inner diameter TD was 302 mm. Here, a surface of the rubber film 3 formed with silicone rubber was subjected to coating processing with a thin polyurethane film having a thickness of approximately several microns for the purpose of improving capability for adhering to the double-stick tape.

With the pressure adjustment mechanisms 7*a* and 7*b*, the pressure P1 of the sealed space 15*b* was adjusted to 15 KPa, and the pressure P2 of the sealed space 15*a* was adjusted to 16.13 KPa so that the polishing stock removal uniformity became a minimum value.

A silicon single crystal wafer having a diameter of 300 mm and a thickness of 775 μm, as the workpiece W, was polished. It is to be noted that both surfaces of the used silicon single crystal wafer was subjected to the first polishing in advance, and its edge portion was also subjected to polishing.

The polishing apparatus provided with the polishing head 1 according to the present invention as described above was used. The used turn table of the polishing apparatus had a diameter of 800 mm. The polishing pad of the type of containing urethane in a nonwoven fabric was used, and its Young's modulus was 2.2 MPa.

With this polishing apparatus, the wafer was polished by the following method.

First, the polishing head 1 and the turn table were rotated at 31, and 29 rpm respectively. While the polishing agent was supplied through the polishing agent supply mechanism, the mid plate 5 was uniformly pressed with a pressure of 17 KPa by the mid-plate-pressing means so that the wafer was brought into sliding contact with the polishing pad to polish the wafer. Here, an alkaline solution containing colloidal silica was used as the polishing agent. The polishing time was 3 minutes.

The polishing stock removal uniformity and the polishing pressure distribution of the wafer polished as described above were evaluated. It is to be noted that the polishing stock removal uniformity is obtained by measuring the thickness of the workpiece before and after polishing in a region excluding an outermost circumferential portion 2 mm width, as a flatness quality area, with a flatness measurement instrument in a diameter direction of the wafer and by taking a difference in the thickness. It is represented by a formula of polishing-stock-removal-uniformity (%)=(maximum polishing-stock-removal in a diameter direction—minimum polishing-stock-removal in a diameter direction)/average polishing-stock-removal in a diameter direction.

Figure 4:
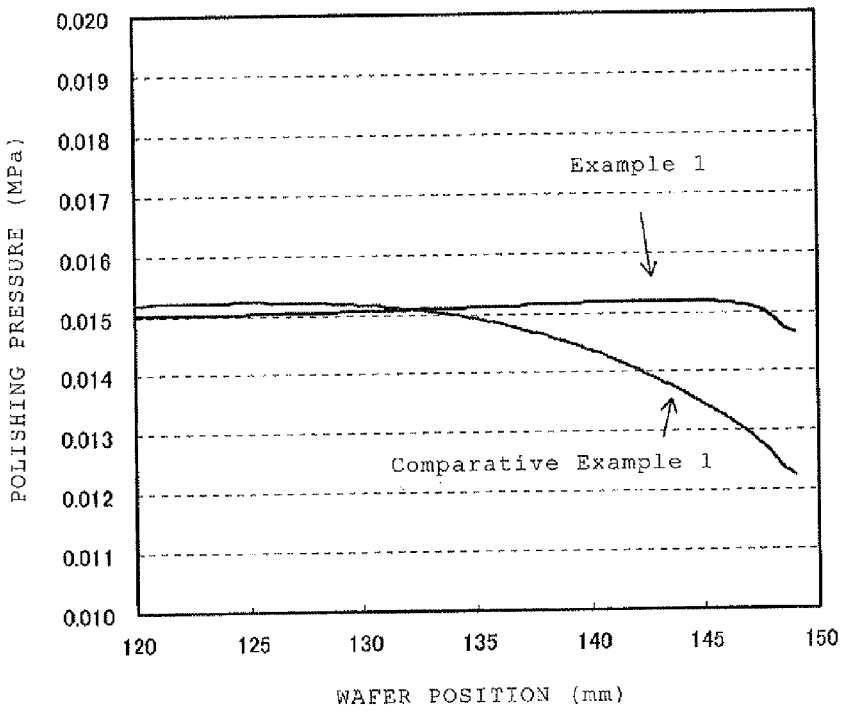
FIG. 4 is a view showing the results of the polishing pressure in Example 1 and Comparative Example 1.

FIG. 4 shows the result of the polishing pressure distribution of the wafer in the range of 120 to 148 mm from its center in a diameter direction. It is to be noted that the polishing pressure distribution was obtained by the conversion of polishing-stock-removal at each position/polishing-stock-removal at the center of the wafer×polishing-load (15 KPa).

As shown in FIG. 4, it was revealed that the uniformity of the polishing pressure was improved in comparison with the later-explained Comparative Example 1.

Accordingly, it was confirmed that since the pressure P2 of the sealed space 15*a* located above the outside of the wafer is adjusted so as to be higher than the pressure P1 of the sealed space 15*b* located above the inside of the wafer in the present invention, a decrease in the polishing pressure at the outer circumferential portion, which is caused by the variation in the position of the lower face of the wafer and template, can be compensated, and a uniform polishing pressure can be thereby obtained.

Figure 7:
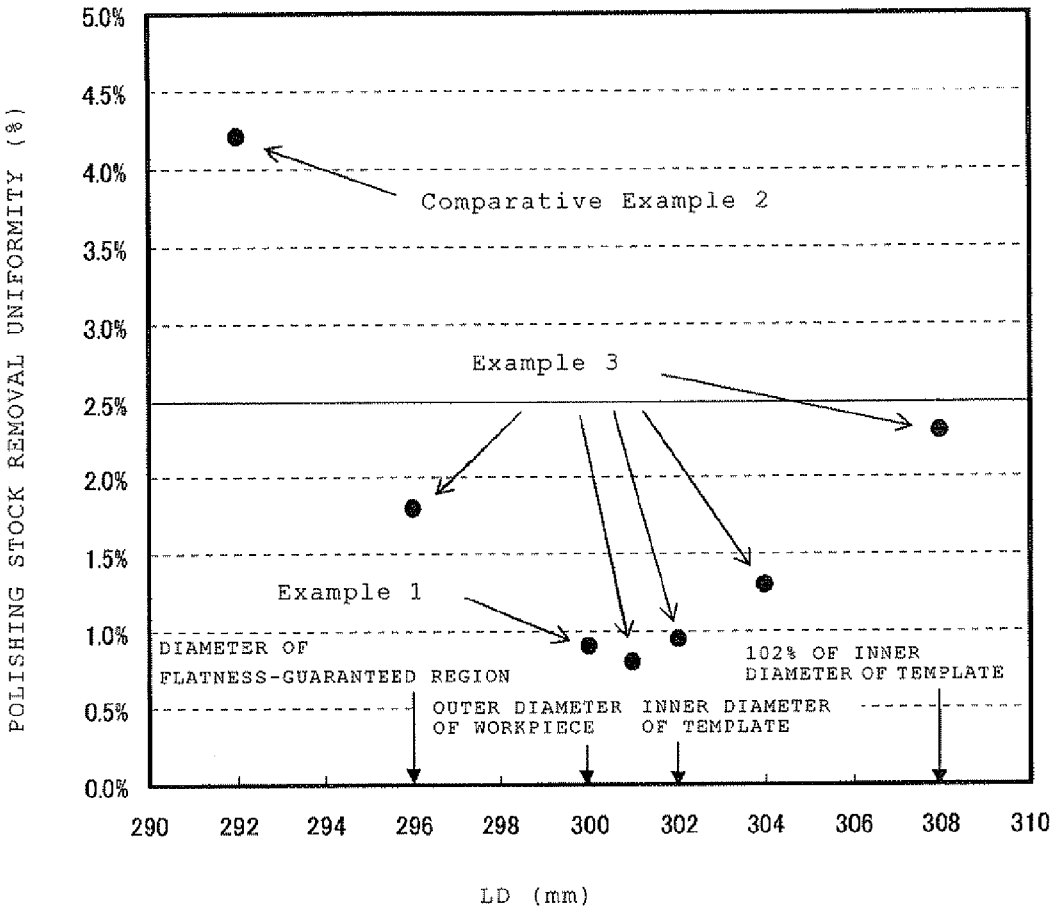
FIG. 7 is a view showing the results of each minimum value of the polishing stock removal uniformity against the outer diameter LD of the sealed space in Example 1, Example 3, and Comparative Example 2.

FIG. 7 shows the result of the polishing stock removal uniformity. As shown in FIG. 7, it was revealed that the polishing stock removal uniformity was approximately 0.9%, and that it was a very good result of 1% or less.

From the above-described results, it is confirmed that the polishing head and polishing apparatus according to the present invention can polish the workpiece with giving a uniform polishing pressure to the workpiece, and even when there are somewhat the variation of the thickness of the workpiece and the template, good flatness and polishing stock removal uniformity can be always secured.

Example 2

A wafer was polished as with Example 1 except for changing the pressure P2 of the sealed space 15*a* to 15 Kpa, 16.13 KPa, 16.5 KPa, and 18 KPa, and the polishing pressure distribution was evaluated.

Figure 5:
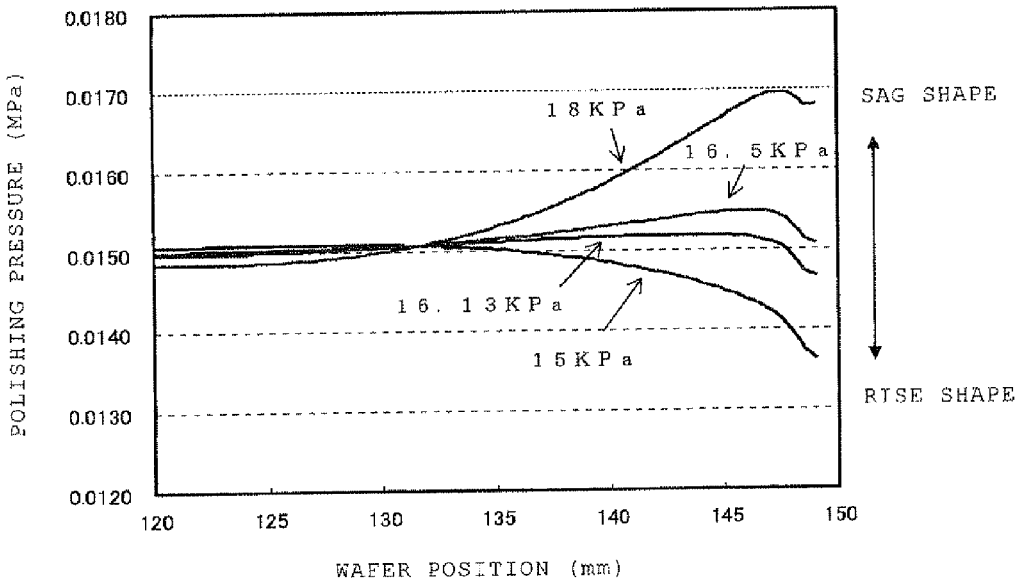
FIG. 5 is a view showing the results of the polishing pressure in Example 1 and Example 2.

FIG. 5 shows the result. As shown in FIG. 5, it is confirmed that the polishing pressure at the outer circumferential portion of the wafer can be changed and the polishing stock removal uniformity can be adjusted by changing the pressure P2.

Example 3

A wafer was polished as with Example 1 except for using the polishing head 1 with the inside sealed space 15*b* having an outer diameter LD of 296 mm, 301 mm, 302 mm, 304 mm, and 308 mm, and for changing the pressure P2 of the sealed space 15*a* in the range of 15 to 30 KPa, and the polishing pressure distribution was evaluated.

Figure 6:
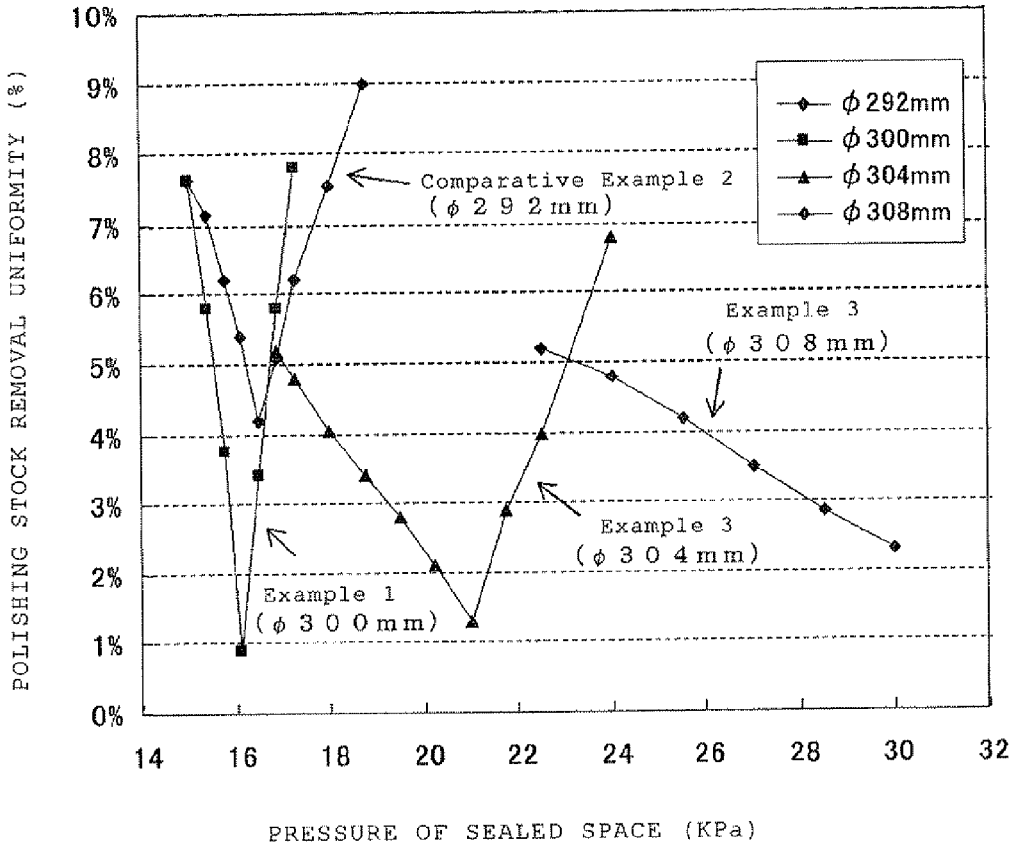
FIG. 6 is a view showing the results of each relationship between the polishing stock removal uniformity and the pressure P2 of the sealed space in Example 1, Example 3, and Comparative Example 2.

FIG. 6 shows the result of the relationship between the polishing stock removal uniformity and the pressure P2 of the sealed space 15*a* in the case of an outer diameter LD of 304 mm, and 308 mm. As shown in FIG. 6, it was revealed that the polishing stock removal uniformity can be improved by adjusting the pressure P2. FIG. 7 shows the results of minimum values of the polishing stock removal uniformity in the case of each outer diameter LD. As shown in FIG. 7, it was revealed that each polishing stock removal uniformity was improved in comparison with the result of the later-explained Comparative Example 2, and they were a good result of 2.5% or less.

Example 4

With the polishing head 21 according to the present invention as shown in FIG. 2 and the polishing apparatus provided with the polishing head 21, a workpiece W was polished and the pressure distribution of the workpiece W during the polishing and the polishing stock removal uniformity were evaluated.

The polishing head 21 was used which had the same structure as Example 1 except that the space 6 was formed by three sealed spaces 25*a*, 25*b*, and 25*c* as described below, and that the pressure of each of the sealed spaces was separately adjusted with the pressure adjustment mechanisms 7*a*, 7*b*, and 7*c*.

The space 6 of the polishing head 21 was divided by the annular wall 16 concentric with the rigid ring 4 to form the sealed space 25*b* having an outer diameter LD1 of 300 mm. Other annular wall 16 concentric with the rigid ring 4 was further arranged inside the sealed space 25*b* so that the inner diameter LD2 of the most inside sealed space 25*c* became 278 mm. Here, the thickness of the wall 16 was 1 mm, and the wall was made of the same material as the rubber film 3.

The pressure P1 of the sealed space 25*c*, the pressure P2 of the sealed space 25*a*, and the pressure P3 of the sealed space 25*b* were adjusted to 15 KPa, 16.13 KPa, and 14.6 KPa with the pressure adjustment mechanisms 7*a*, 7*b*, and 7*c* respectively.

With the polishing apparatus having the same structure as Example 1 except for providing with this polishing head 21, the same workpiece W as Example 1 was polished by the same method as Example 1, and the polishing stock removal uniformity was evaluated.

Figure 8:
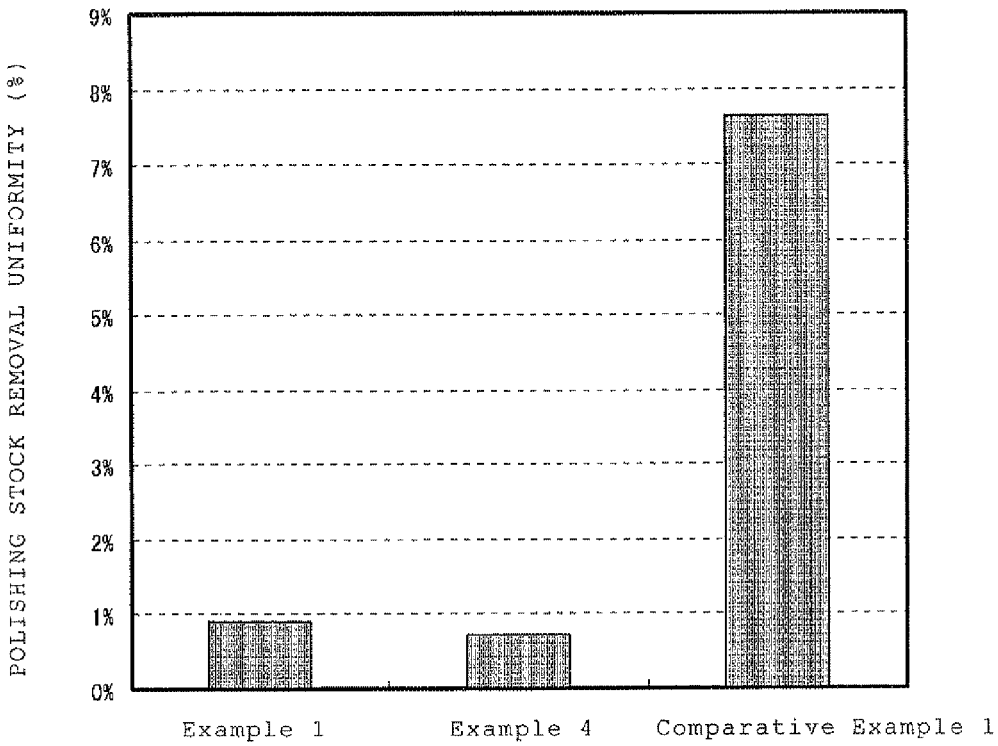
FIG. 8 is a view showing the results of the polishing stock removal uniformity in Example 1, Example 4, and Comparative Example 1.

FIG. 8 shows the result. As shown in FIG. 8, it was revealed that the polishing stock removal uniformity was further improved in comparison with the result of Example 1, and it was a level of 1% or less.

Comparative Example 1

Figure 9:
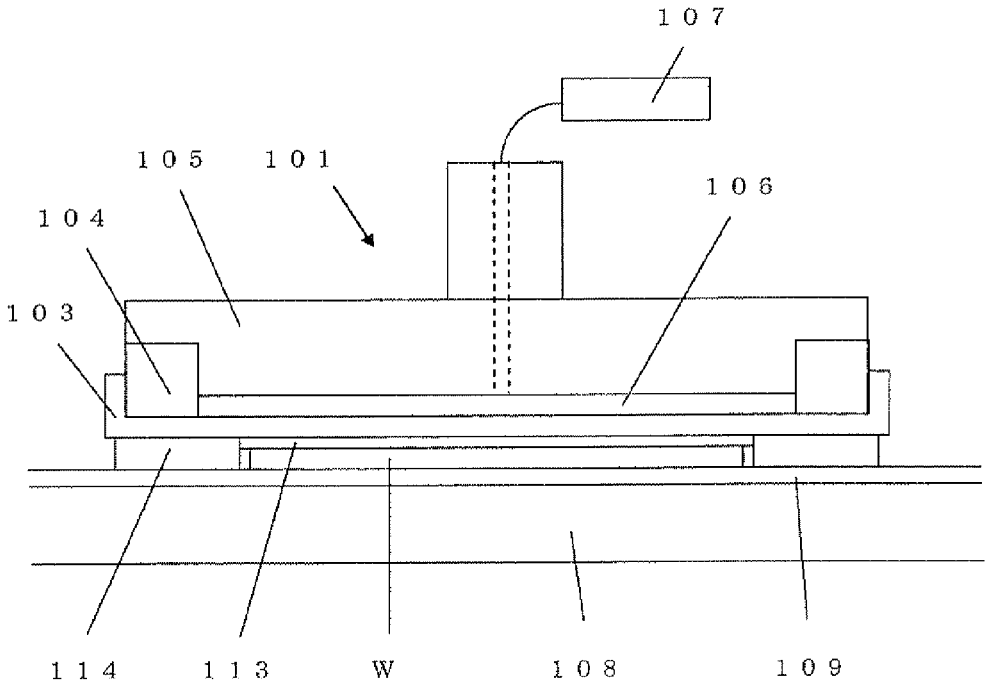
FIG. 9 is a schematic view showing an example of a conventional polishing head.
Figure 10:
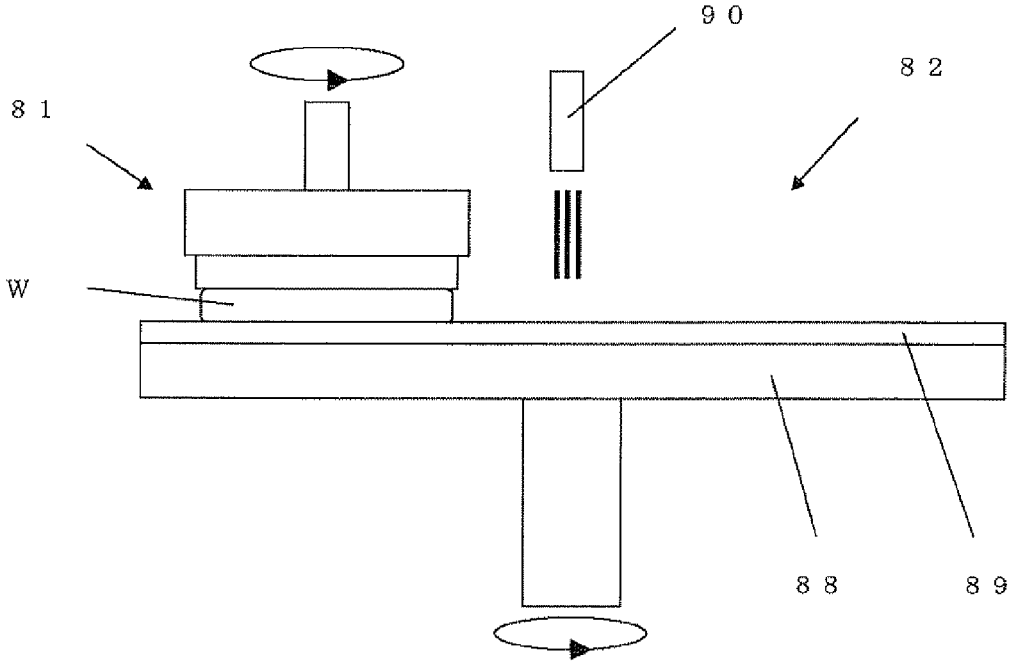
FIG. 10 is a schematic view showing an example of a conventional single-side polishing apparatus.

A silicon single crystal wafer was polished in the same conditions as Example 1 except for using a conventional polishing head as shown in FIG. 9 and a conventional polishing apparatus provided with the conventional polishing head, and the polishing stock removal uniformity and the polishing pressure distribution were evaluated.

FIG. 4 shows the result of the polishing stock removal uniformity. As shown in FIG. 4, it was revealed that the polishing stock removal uniformity became worse in comparison with the result of Example 1.

It can be considered that this was caused by decreasing the pressure at the outer circumferential portion of the wafer, since the template having a thickness of 800 μm was thicker than the wafer having a thickness of 775 μm so that the position of the lower face of the template protruded downward from the position of the lower face of the wafer.

FIG. 8 shows the result of the polishing stock removal uniformity. As shown in FIG. 8, it was revealed that the polishing stock removal uniformity was approximately 7.7%, and it became greatly worse in comparison with the results of Examples 1 and 2.

Comparative Example 2

A wafer was polished as with Example 1 except for using the polishing head with the inside sealed space having an outer diameter LD of 292 mm, and the polishing stock removal uniformity was evaluated.

FIG. 7 shows the result. As shown in FIG. 7, the polishing stock removal uniformity was somewhat improved in comparison with the result of 7.7% of Comparative Example 1 by dividing the space by the wall to form the sealed spaces and by adjusting the pressure of each of the sealed spaces. However, the polishing stock removal uniformity became worse in comparison with the results of Examples 1 and 3.

Accordingly, it is confirmed that the outer diameter of one inside sealed space of the plurality of sealed spaces divided by the annular wall of the polishing head is necessary to be formed so as to be equal to or more than the diameter of the flatness-guaranteed region of the workpiece, in order to obtain a good result of the polishing stock removal uniformity.

It is to be noted that the present invention is not restricted to the foregoing embodiment. The embodiment is just an exemplification, and any examples that have substantially the same feature and demonstrate the same functions and effects as those in the technical concept described in claims of the present invention are included in the technical scope of the present invention.

For example, the polishing head manufactured by a manufacturing method according to the present invention is not restricted to embodiments shown in FIGS. 1 and 2. For example, the shape of the mid plate may be appropriately designed.

The invention claimed is:

1. A polishing head configured to operate by a rubber-chuck method, the polishing head including at least:

an annular rigid ring;

a rubber film bonded to the rigid ring with a uniform tension;

a mid plate joined to the rigid ring, the mid plate forming a space together with the rubber film and the rigid ring;

an annular template provided concentrically with the rigid ring in a peripheral portion on a lowermost face portion of the rubber film; and a pressure adjustment mechanism configured to change pressure of the space, the polishing head holding a back surface of a workpiece on the lowermost face portion of the rubber film, holding an edge portion of the workpiece with the template, pressing the workpiece toward a polishing pad by inflating the rubber film with the pressure of the space, and polishing the workpiece by bringing a surface of the workpiece into sliding contact with the polishing pad attached onto a turn table, wherein the space is divided by at least one annular wall concentric with the rigid ring to form a plurality of sealed spaces; an outer diameter of at least one inside sealed space of the plurality of sealed spaces divided by the at least one annular wall is formed so as to be equal to or more than a diameter of a flatness-guaranteed region of the workpiece and to be equal to or less than 102% of an inner diameter of the template; and the pressure adjustment mechanism separately controls pressure of each of the plurality of sealed spaces.

2. The polishing head according to claim 1, wherein at least one other sealed space concentric with the rigid ring is further formed inside the sealed space having the outer diameter formed so as to be equal to or more than the diameter of the flatness-guaranteed region of the workpiece.

3. The polishing head according to claim 2, wherein the workpiece to be polished is a silicon single crystal wafer having a diameter of 300 mm or more.

4. The polishing head according to claim 1, wherein the workpiece to be polished is a silicon single crystal wafer having a diameter of 300 mm or more.

5. The polishing head according to claim 1, wherein the at least one inside sealed space is closer to a center of the annular rigid ring than at least one outside sealed space of the plurality of sealed spaces.

6. The polishing head according to claim 1, wherein an outer diameter of the annular template is less than an outer diameter of the rubber film.

7. A polishing apparatus configured to polish a surface of a workpiece including at least a polishing pad attached onto a turn table, a polishing agent supply mechanism for supplying configured to supply a polishing agent onto the polishing pad, and a polishing head configured to operate by a rubber-chuck method, the polishing head including at least: an annular rigid ring; a rubber film bonded to the rigid ring with a uniform tension; a mid plate joined to the rigid ring, the mid plate forming a space together with the rubber film and the rigid ring; an annular template provided concentrically with the rigid ring in a peripheral portion on a lowermost face portion of the rubber film; and a pressure adjustment mechanism configured to change pressure of the space, the polishing head holding a back surface of a workpiece on the lowermost face portion of the rubber film, holding an edge portion of the workpiece with the template, pressing the workpiece toward the polishing pad by inflating the rubber film with the pressure of the space, and polishing the workpiece by bringing a surface of the workpiece into sliding contact with the polishing attached onto the turn table, wherein the space is divided by at least one annular wall concentric with the rigid ring to form a plurality of sealed spaces; an outer diameter of at least one inside sealed space of the plurality of sealed spaces divided by the at least one annular wall is formed so as to be equal to or more than a diameter of a flatness-guaranteed region of the workpiece and to be equal to or less than 102% of inner diameter of the template; and the pressure adjustment mechanism separately controls pressure of each of the plurality of sealed spaces.

8. A polishing apparatus configured to polish a surface of a workpiece including at least a polishing pad attached onto a turn table, a polishing agent supply mechanism configured to supply a polishing agent onto the polishing pad, and a polishing head configured to operate by a rubber-chuck method, the polishing head including at least: an annular rigid ring; a rubber film bonded to the rigid ring with a uniform tension; a mid plate joined to the rigid ring, the mid plate forming a space together with the rubber film and the rigid ring; an annular template provided concentrically with the rigid ring in a peripheral portion on a lowermost face portion of the rubber film; and a pressure adjustment mechanism configured to change pressure of the space, the polishing head holding a back surface of a workpiece on the lowermost face portion of the rubber film, holding an edge portion of the workpiece with the template, pressing the workpiece toward the polishing pad by inflating the rubber film with the pressure of the space, and polishing the workpiece by bringing a surface of the workpiece into sliding contact with the polishing attached onto the turn table, wherein the space is divided by at least one annular wall concentric with the rigid ring to form a plurality of sealed spaces; an outer diameter of at least one inside sealed space of the plurality of sealed spaces divided by the at least one annular wall is formed so as to be equal to or more than a diameter of a flatness-guaranteed region of the workpiece and to be equal to or less than 102% of inner diameter of the template; wherein at least one other sealed space concentric with the rigid ring is further formed inside the sealed space having the outer diameter formed so as to be equal to or more than the diameter of the flatness-guaranteed region of the workpiece; and the pressure adjustment mechanism separately controls pressure of each of the plurality of sealed spaces.

9. A polishing apparatus configured to polish a surface of a workpiece including at least a polishing pad attached onto a turn table, a polishing agent supply mechanism configured to supply a polishing agent onto the polishing pad, and a polishing head configured to operate by a rubber-chuck method, the polishing head including at least: an annular rigid ring; a rubber film bonded to the rigid ring with a uniform tension; a mid plate joined to the rigid ring, the mid plate forming a space together with the rubber film and the rigid ring; an annular template provided concentrically with the rigid ring in a peripheral portion on a lowermost face portion of the rubber film; and a pressure adjustment mechanism configured to change pressure of the space, the polishing head holding a back surface of a workpiece on the lowermost face portion of the rubber film, holding an edge portion of the workpiece with the template, pressing the workpiece toward the polishing pad by inflating the rubber film with the pressure of the space, and polishing the workpiece by bringing a surface of the workpiece into sliding contact with the polishing attached onto the turn table, wherein the space is divided by at least one annular wall concentric with the rigid ring to form a plurality of sealed spaces; an outer diameter of at least one inside sealed space of the plurality of sealed spaces divided by the at least one annular wall is formed so as to be equal to or more than a diameter of a flatness-guaranteed region of the workpiece and to be equal to or less than 102% of inner diameter of the template; the pressure adjustment mechanism separately controls pressure of each of the plurality of sealed spaces; and wherein the workpiece to be polished is a silicon single crystal wafer having a diameter of 300 mm or more.

10. A polishing apparatus configured to polish a surface of a workpiece including at least a polishing pad attached onto a turn table, a polishing agent supply mechanism configured to supply a polishing agent onto the polishing pad, and a polishing head configured to operate by a rubber-chuck method, the polishing head including at least: an annular rigid ring; a rubber film bonded to the rigid ring with a uniform tension; a mid plate joined to the rigid ring, the mid plate forming a space together with the rubber film and the rigid ring; an annular template provided concentrically with the rigid ring in a peripheral portion on a lowermost face portion of the rubber film; and a pressure adjustment mechanism configured to change pressure of the space, the polishing head holding a back surface of a workpiece on the lowermost face portion of the rubber film, holding an edge portion of the workpiece with the template, pressing the workpiece toward the polishing pad by inflating the rubber film with the pressure of the space, and polishing the workpiece by bringing a surface of the workpiece into sliding contact with the polishing attached onto the turn table, wherein the space is divided by at least one annular wall concentric with the rigid ring to form a plurality of sealed spaces; an outer diameter of at least one inside sealed space of the plurality of sealed spaces divided by the at least one annular wall is formed so as to be equal to or more than a diameter of a flatness-guaranteed region of the workpiece and to be equal to or less than 102% of inner diameter of the template; wherein at least one other sealed space concentric with the rigid ring is further formed inside the sealed space having the outer diameter formed so as to be equal to or more than the diameter of the flatness-guaranteed region of the workpiece; the pressure adjustment mechanism separately controls pressure of each of the plurality of sealed spaces; and wherein the workpiece to be polished is a silicon single crystal wafer having a diameter of 300 mm or more.

* * * * *